US007577343B2

(12) United States Patent
Chiang

(10) Patent No.: US 7,577,343 B2
(45) Date of Patent: Aug. 18, 2009

(54) STEAM GENERATING DEVICE

(76) Inventor: Li-Yuan Chiang, No. 607-1, Sinjhuang City, Taipei County (TW) 24262

( * ) Notice: Subject to any disclaimer, the term of this patent is extended or adjusted under 35 U.S.C. 154(b) by 525 days.

(21) Appl. No.: 11/352,196

(22) Filed: Feb. 13, 2006

(65) Prior Publication Data

US 2007/0187389 A1 Aug. 16, 2007

(51) Int. Cl.
*F22B 1/28* (2006.01)
*F22B 27/14* (2006.01)

(52) U.S. Cl. ..... 392/399; 99/468; 122/40

(58) Field of Classification Search ..... None
See application file for complete search history.

(56) References Cited

U.S. PATENT DOCUMENTS 1,475,589 A * 11/1923 Marden ..... 122/32
2,097,581 A * 11/1937 Beyrodt ..... 392/396
2,097,582 A * 11/1937 Beyrodt ..... 392/396
4,572,943 A * 2/1986 Hogfeldt ..... 392/396
4,836,145 A * 6/1989 Ronchi nee Marchesin . 122/4 A
4,990,745 A * 2/1991 Bayles et al. ..... 392/399
5,249,624 A * 10/1993 Pow et al. ..... 165/110
5,265,318 A * 11/1993 Shero ..... 392/399
5,949,958 A * 9/1999 Naperkowski et al. ..... 392/399
6,748,904 B1 * 6/2004 Chiang ..... 122/40
7,031,601 B2 * 4/2006 Zheng ..... 392/394
2007/0223894 A1 * 9/2007 Cheung ..... 392/405

* cited by examiner

*Primary Examiner*—Joseph M Pelham

(57) ABSTRACT

A steam generating device includes a flat casing and a heating device is received in the casing. The heating device includes flanges which are engaged with grooves in the casing so as to define a lower space and an upper space between the heating device and the inner periphery of the casing. A seal is clamped between the heating device and casing to prevent foreign objects entering the casing. The heating device includes a chamber which is in communication with a hole defined in the bottom of the casing. Water is introduced into the lower space and steamized by the heating device, the steam enters into the upper space via passages and enters into the camber and blasts out from the hole of the casing. The steam travels a long path in the casing and is heated sufficiently so as to increase the efficiency for generating the steam.

9 Claims, 7 Drawing Sheets

STEAM GENERATING DEVICE

FIELD OF THE INVENTION

The present invention relates to a steam generating device for efficiently generating steam.

BACKGROUND OF THE INVENTION

A conventional steam generating device is disclosed in U.S. Pat. No. 6,748,904, and which includes a metal casing with a plurality of cambers defined therein and a heating member is received in the casing. The chambers are in communication with each other so that water in the casing can be heated in each chamber in sequence, and then enter into a steam room. The heating member is made by metal and is connected to the casing. No proper sealing device is provided between the casing the heating member so that water might enters into the steam room and the temperature of the steam is therefore reduced. Part of the steam is cooled into liquid water so that the steam blast out from the steam generating device includes liquid water particles. Besides, the steam generating device includes a cylindrical body which occupies too much space. In addition, the path that the water and steam travels is short and the distance that the blast hole and the communication path between the chamber and room is too long so that it requires a large pressure to push the steam from this end to that end of the casing. Therefore, the steam generated does not have sufficient high pressure and high temperature.

The present invention intends to provide a compact steam generating device that includes curved paths so that the water can be heated during the long travel and the steam includes expected high pressure and temperature.

SUMMARY OF THE INVENTION

The present invention relates to a steam generating device which comprises a flat casing including a first body which has a hollow interior and two grooves are defined in an inner periphery of the hollow interior such that a heating device is received in the interior of the first body by engaging two flanges with the two grooves. A hole is defined through an underside of the first body. An end connection plate extends from the open end of the casing and a seal is engaged with a receiving groove in the end connection plate. The heating device has an end board which is connected to the end connection plate of the casing so that the seal is clamped between the end connection plate and the end board. A passage is defined through a second body of the heating device and located in a notch at one of the two flanges. An inlet is defined through the end board and located at a lower part of the end board. A chamber is defined in a center of the second body and the hole in the first body communicates with the chamber. A lower space is defined between the outside of the second body and the inner periphery of the first body and beneath the at least two flanges. An upper space is defined between the outside of the second body and the inner periphery of the first body and above the at least two flanges. The upper space communicates with the passage and the chamber.

The steam travels the lower space and is heated to become steam which then enters into the upper space and enters into the chamber. The travel distance of the water is long enough so that the water is heated for longer time. The steam is still heated in the chamber so that the temperature of the steam can be maintained at desired high temperature.

The steam generating device is compact and the seal between the end plate of the first body and the end board of the second body effectively avoid from leakage.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
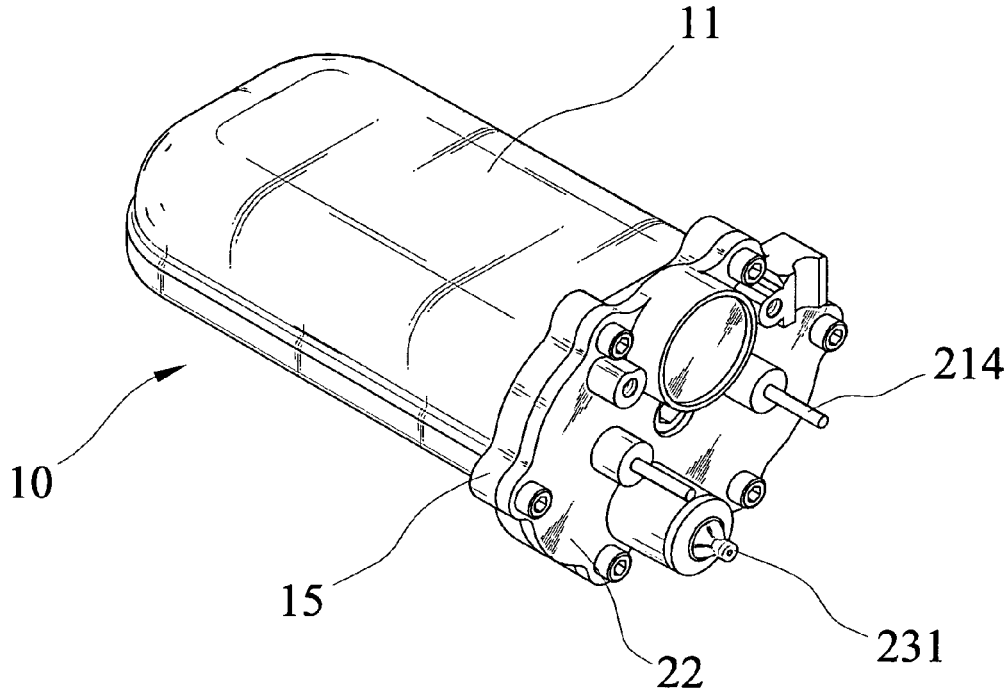
FIG. 1 is a perspective view to show the steam generating device of the present invention.
Figure 2:
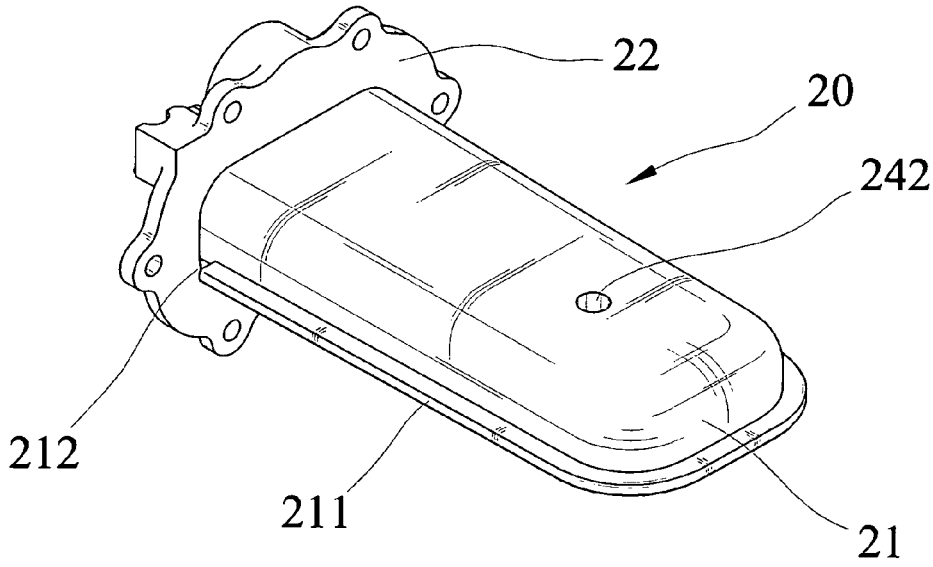
FIG. 2 is a perspective view, from another angle, of the steam generating device of the present invention.
Figure 3:
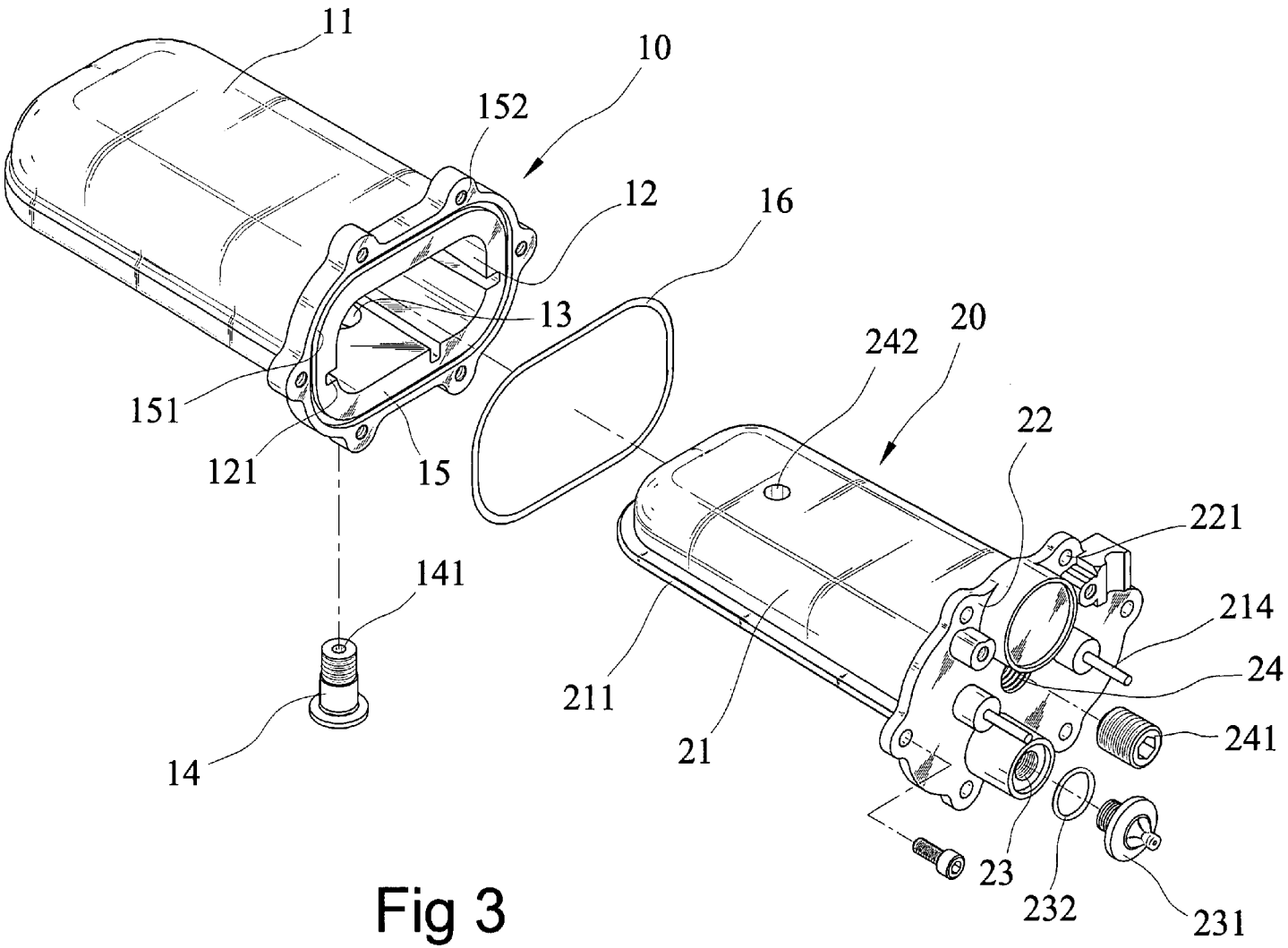
FIG. 3 is an exploded view to show the steam generating device of the present invention.
Figure 4:
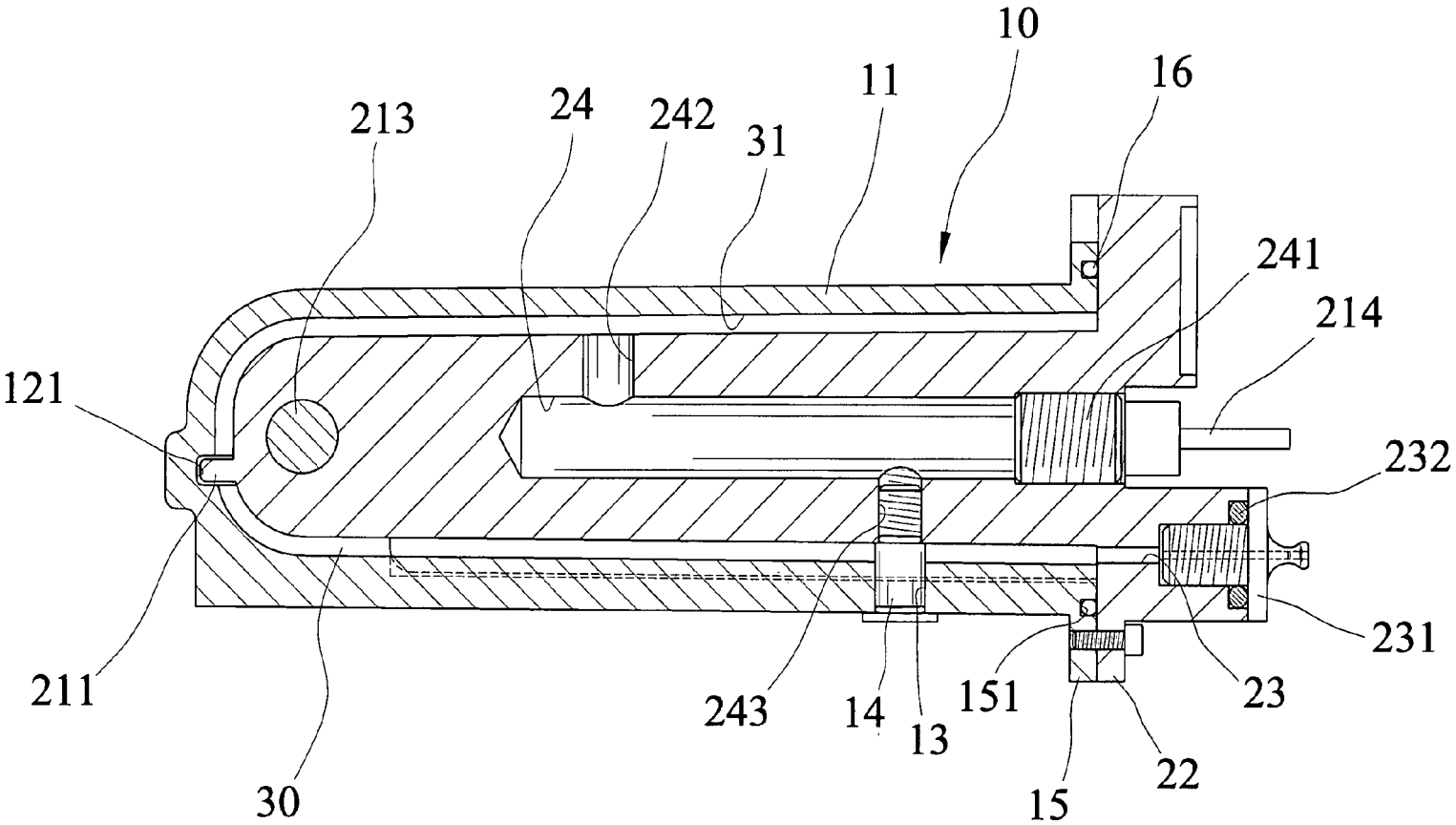
FIG. 4 is a side cross sectional view of the steam generating device of the present invention.
Figure 5:
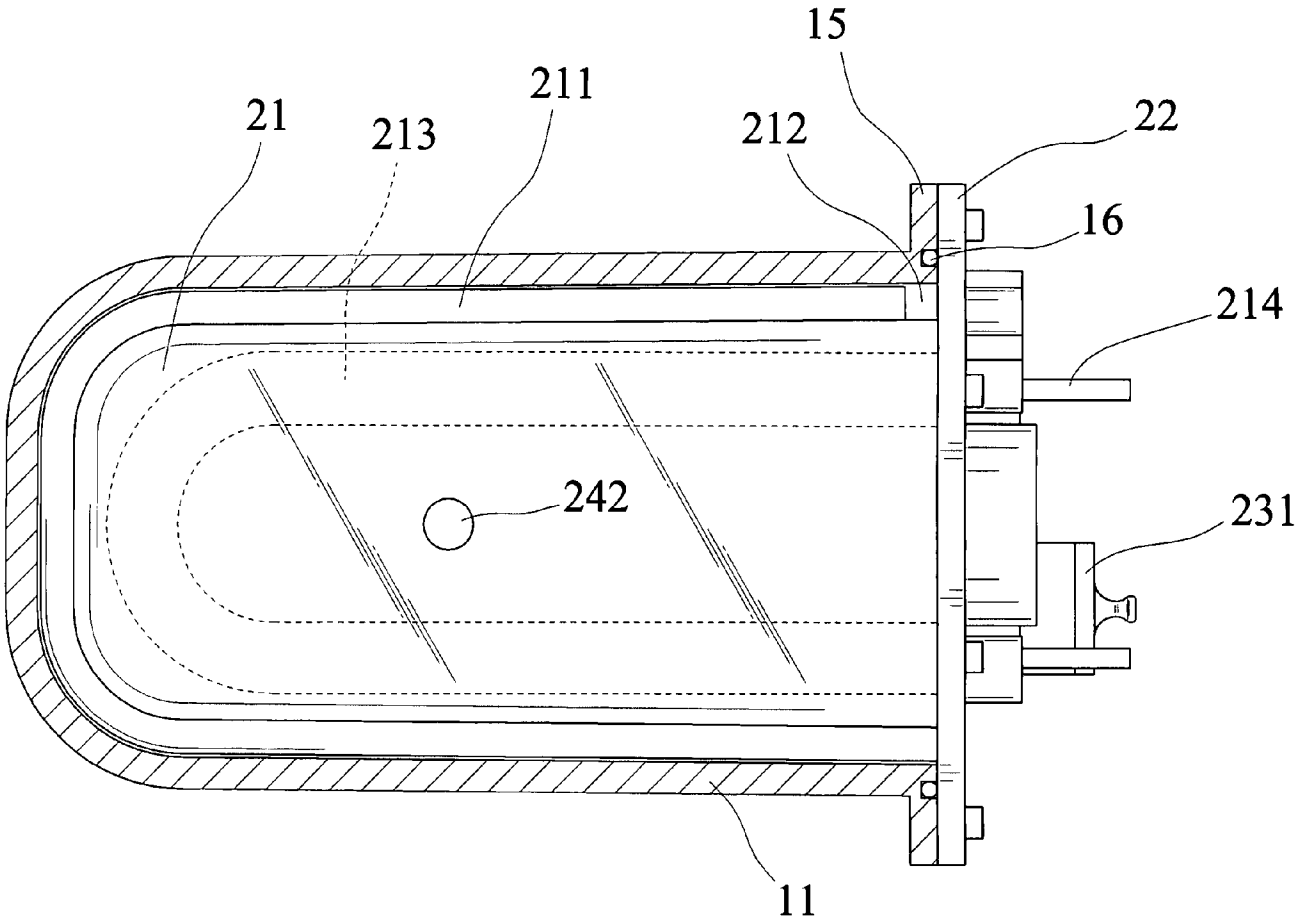
FIG. 5 is a top cross sectional view of the steam generating device of the present invention.
Figure 6:
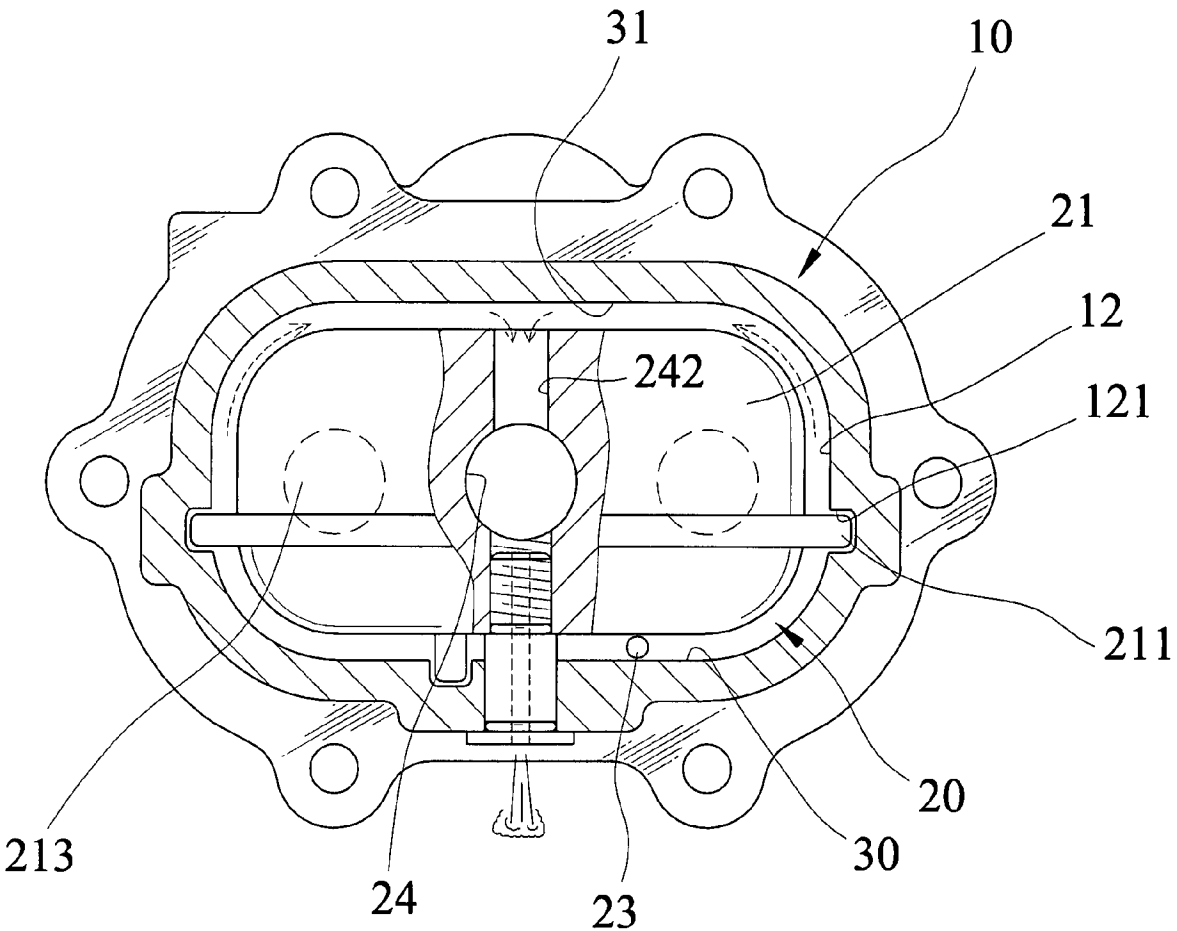
FIG. 6 is an end cross sectional view of the steam generating device of the present invention.

Referring to FIGS. 1 to 6, the steam generating device of the present invention comprises a flat casing 10 including a first body 11 which has a flat 0-shaped cross section and includes substantially parallel planar top and bottom surfaces, the surfaces are separated by a distance which is substantially less than the width of the planar surfaces. The flat casing 10 includes a closed end and an open end. A hollow interior 12 is defined in the easing 10 and two grooves 121 are defined in an inner periphery of the hollow interior 12. An end connection plate 15 extends perpendicularly outward from the open end of the casing 10 and includes a plurality of threaded connection holes 152. A seal 16 is engaged with a receiving groove 151 defined in the end connection plate 15. A hole 13 is defined through the planar bottom surface of the first body 11.

A heating device 20 has a second body 21 which is sized and shaped to be received in the interior 12 of the casing 10. Two elongate ridges 211 extend from the outside of the second body 21. in a direction substantially parallel to the upper and lower surfaces of the second body and are slidably engaged with the two grooves 121. The second body 21 has an end board 22 which has a plurality of through holes 221. Bolts extend through the through holes 221 and are connected with the threaded connection holes 152 so that the seal 16 is clamped between the end connection plate 15 and the end board 22. It is noted tat the seal 16 is located away from the heating member 213 so that the seal 16 can be avoided from being melted by the high temperature from the heating member 213. A passage 212 is defined trough the second body 21 and located in a notch at one of the at least two elongate ridges 211. An inlet 23 is defined through the end board 22 and located at a lower part of the end board 22. The inlet 23 is sealed by an inlet valve 231 with a seal. 232 mounted on the inlet valve 231. A chamber 24 is defined in a center of the second body 21 and the hole 13 in the first body 10 communicates with the chamber 24. The chamber 24 opens to the end board 22 and a bolt 241 is connected to the end board 22 to seal the chamber 24. A lower space 30 is defined between the outside of the lower surface of the second body 21 and the inner periphery of the planar bottom surface of the first body 11 end, beneath the at least two elongate ridges 211. An upper space 31 is defined between the outside of the upper surface of the second body 21 and the inner periphery of the planar top surface of the first body 11 and, above the at least two elongate ridges 211. The upper space 31 communicates with the passage 212 and the chamber 24.

A communication hole 243 is defined through the lower surface the heating device 20 and communicates with the chamber 24 and the hole 13 defined through the the planar bottom surface of the first body 11. A blast valve 14 is engaged with the hole 13 in the first body 11 and includes a blade hale 141. A heating member 213 is received in the second body 21 of the heating device 20 and two terminals 214 extend from the end board 22, which are electrically connected to the heating member 213. A connection path 242 is defined in the second body 21 and communicates between the chamber 24 and the upper space 31. The connection path 242 is located at a distance along a longitudinal direction of the second body 21 from the inlet 23.

When the terminals 214 are connected to a power supply (not shown), water is pumped into the lower space 30 via the inlet valve 231 and the inlet 23. The water is heated to boil by the heating member 213 and steam moves upward and along the flanges 211 and enters into the upper space 31 via the passage 212. The steam then enters into the chamber 24 via the connection path 242 and moves along the axis of the second body 21. During the movement, the steam is heated and then blasts out from the blast hole 141 at a high pressure and high temperature.

Figure 7:
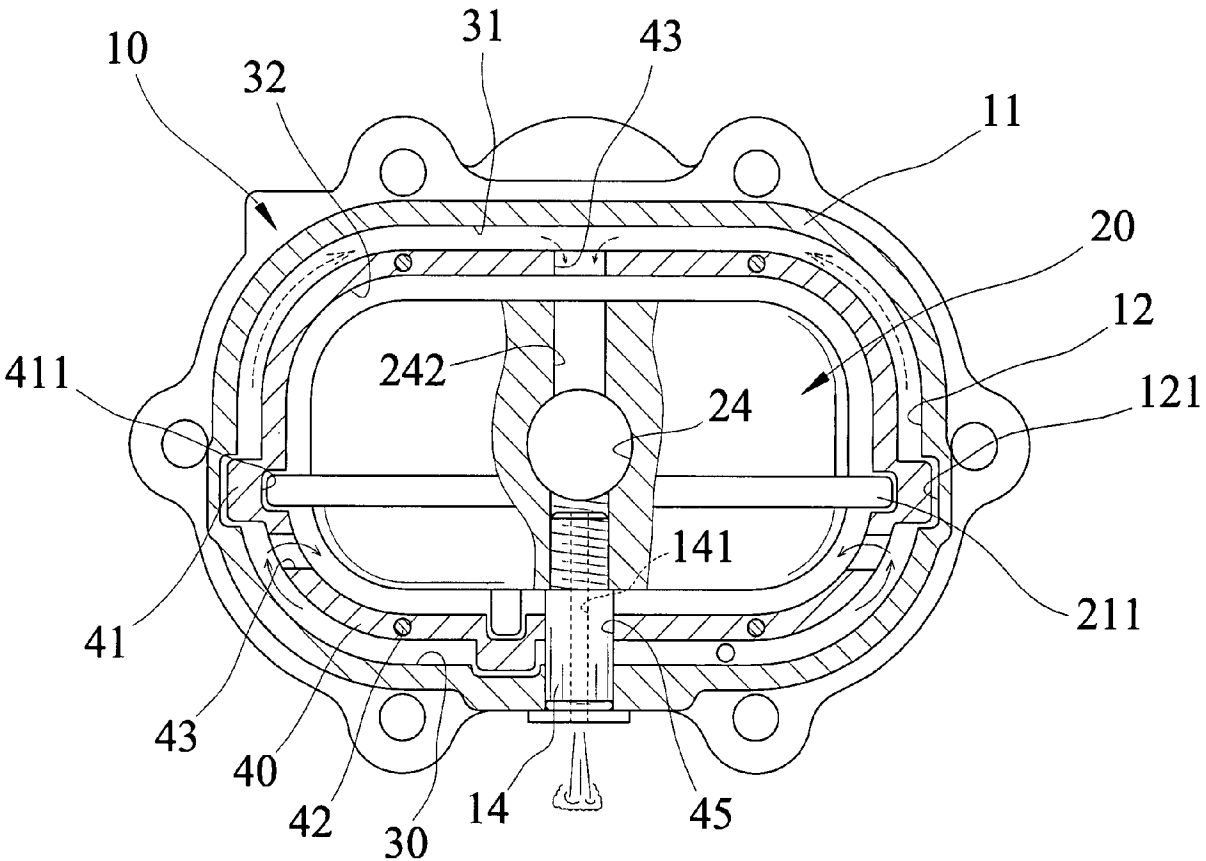
FIG. 7 is an end cross sectional view of another embodiment of the steam generating device of the present invention.
Figure 8:
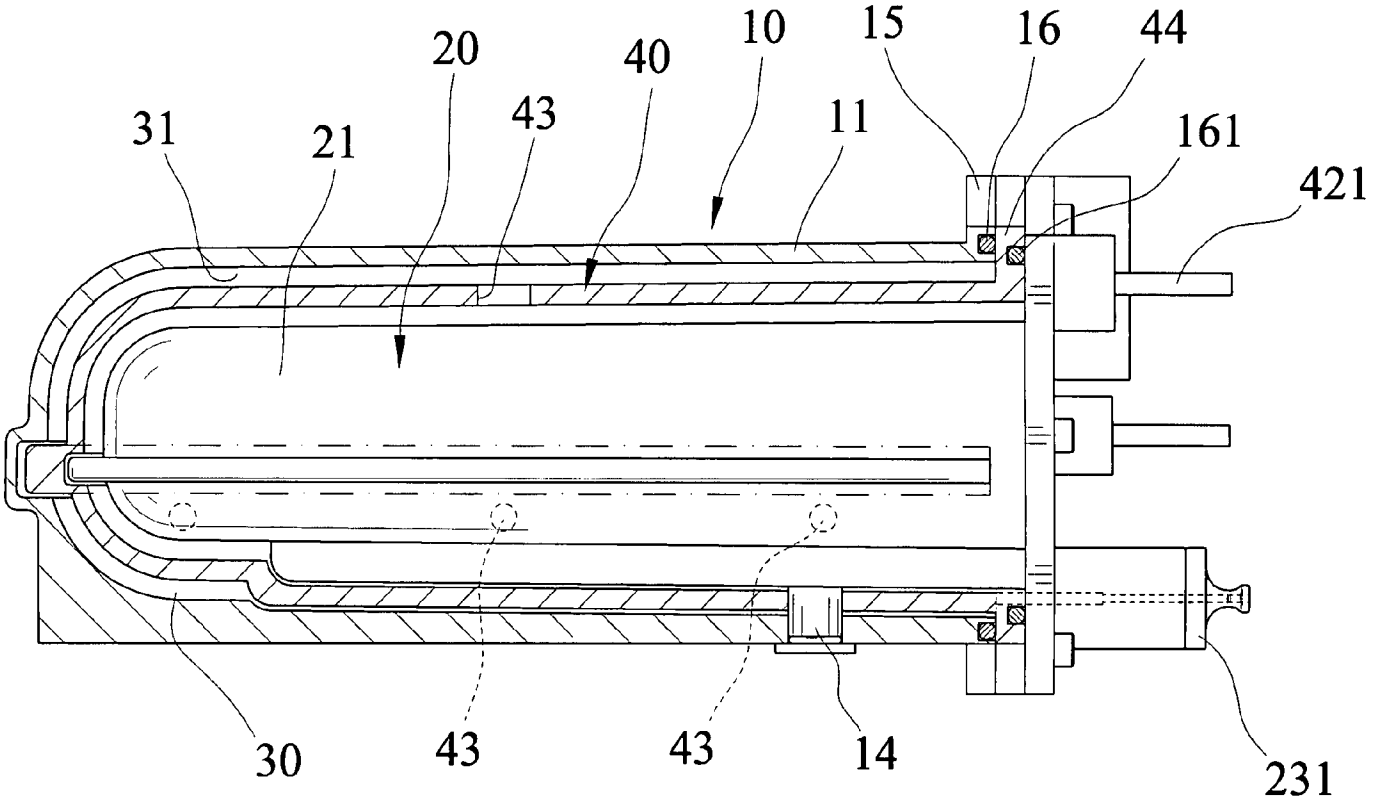
FIG. 8 is a side cross sectional view of the steam generating device in FIG. 7.

FIGS. 7 and 8 show another embodiment of the present invention wherein an intermediate heating device 40 is located between the casing 10 and the heating device 20. The intermediate heating device 40 includes two second flanges 41 on an outside thereof and the second flanges 41 are engaged with the two grooves 121 of the casing 10. The intermediate heating device 40 has an aperture 45 which is in communication with the hole 13 in the underside of the second body 21. A plurality of through holes 43 are defined in the intermediate hearing device 40 and one of the through holes 43 is in communication with the connection path 242. A lower space 30 is defined between the inner periphery of the first body 11 and the outside of the intermediate heating device 40 and, beneath of the at least two second flanges 41. An upper space 31 is defined between the outside of the intermediate hearing device 40 and the inner periphery of the first body 11 and, above the at least two second flanges 41. An inner space 32 is defined between the inner periphery of the intermediate heating device 40 and the outside of the heating device 20. The inner space 32 is in communication with the upper space 31 and the lower space 30 via the through holes 43. The intermediate heating device 40 includes an end flange 44 at an end thereof and a plurality of heating members 42 are received in the intermediate heating device 40. Two terminals 421 extend from the end flange 44 and are electrically connected to the heating members 42.

Water is introduced into the lower space 30 via the inlet valve 231 and is heated by the intermediate heating device 40 so that a part of the water becomes steam. The water and steam enter into the inner space 32 via the through holes 43. The water and steam are heated by the heating device 20 and the steam enters into the upper portion of the inner space 32 via the passage 212. The steam in the lower space 30 enters into the inner space 32 via the upper space 31 and the through holes 43. Finally, the steam enters into the chamber 24 and blasts out from the blast valve 14. The water and steam can be heated twice to increase the pressure and the temperature of the steam.

While we have shown and described the embodiment in accordance with the present invention, it should be clear to those skilled in the art that further embodiments may be made without departing from the scope of the present invention.

What is claimed is:

1. A steam generating device comprising:

a flat casing including a first body and including a closed end and an open end, a hollow interior defined in the casing and at least two grooves defined in an inner periphery of the hollow interior, the flat casing including substantially parallel planar top and bottom surfaces, the surfaces being separated by a distance which is substantially less than a width of the planar surfaces, a hole defined through the planar bottom surface of the first body, an end connection plate extending from the open end of the casing and a seal engaged with a receiving groove defined in the end connection plate, and a heating device having a second body which is sized and shaped to be received in. the interior of the casing, the second body having an end board which is connected to the end connection plate of the casing so that the seal is clamped between the end connection plate and the end board, at least two elongate ridges extending from an outside of the second body in a direction substantially parallel to upper and lower surfaces of the second body and slidably engaged with the at least two grooves, a passage defined through the second body and located in a notch at one of the at least two elongate ridges, an inlet defined through the end board and located at a lower part of the end board, a chamber defined in a center of the second body and the hole in the first body communicating with the chamber, a lower space defined between the outside of the lower surface of the second body and the inner periphery of the planar bottom surface of the first body and beneath the at least two elongate ridges, an upper space defined between the outside of the upper surface of the second body and the inner periphery of the planar top surface of the first body and above the at least two elongate ridges, the upper space communicating with the passage and the chamber.

2. The device as claimed in claim 1, wherein the heating device includes a communication hole defined through the lower surface and the communication hole communicates with the chamber and the hole defined through the planar bottom surface of the first body, a blast valve is engaged with the hole in the first body and includes a blade hole, the end connection plate includes a plurality of threaded connection holes and the end board has a plurality of through holes, bolts extend through the through holes and are connected with the threaded connection holes.

3. The device as claimed in claim 1, wherein a heating member is received in the second body of the heating device and two terminals extend from the end board and are electrically connected to the heating member.

4. The device as claimed in claim 1, wherein the inlet is sealed by a inlet valve and a seal is mounted on the inlet valve, the chamber opens to the end board and a bolt is connected to the end board and seals the chamber.

5. The device as claimed in claim 1, wherein a connection path is defined in the second body and communicates between the chamber and the upper space.

6. The device as claimed in claim 5, wherein the connection path is located at a distance along a longitudinal direction of the second body from the inlet.

7. The device as claimed in claim 1, wherein an intermediate heating device is located between the casing and the heating device.

8. The device as claimed in claim 7, wherein the intermediate heating device includes at least two second flanges on an outside thereof and the second flanges are engaged with the at least two grooves of the casing, the intermediate heating device has an aperture which is in communication with the hole in the underside of the second body, a plurality of through holes are defined in the intermediate hearing device and at least one of the through holes is in communication with the connection path, a lower space is defined between the inner periphery of the first body and the outside of the intermediate heating device and beneath of the at least two second flanges, an upper space is defined between the outside of the intermediate hearing device and the inner periphery of the first body and above the at least two second flanges, an inner space is defined between the inner periphery of the intermediate heating device and the outside of the heating device, the inner space is in communication with the upper space and the lower space via the through holes.

9. The device as claimed in claim 8, wherein the intermediate heating device includes an end flange at an end thereof and a plurality of heating members are received in the intermediate heating device, two terminals extend from the end flange and are electrically connected to the heating members.

* * * * *